United States Patent [19]

Denz

[11] Patent Number: 4,700,673

[45] Date of Patent: Oct. 20, 1987

[54] METHOD OF CONTROLLING THE OPERATING CHARACTERISTIC QUANTITIES OF AN INTERNAL COMBUSTION ENGINE

[75] Inventor: Helmut Denz, Stuttgart, Fed. Rep. of Germany

[73] Assignee: Robert Bosch GmbH, Stuttgart, Fed. Rep. of Germany

[21] Appl. No.: 870,131

[22] Filed: Jun. 3, 1986

[30] Foreign Application Priority Data

Jun. 15, 1985 [DE] Fed. Rep. of Germany ..... 3521551

[51] Int. Cl.[4] ..... F02D 41/12; F02D 35/00

[52] U.S. Cl. ..... 123/325; 123/324; 123/585; 123/198 DB; 123/333

[58] Field of Search ..... 123/198 DB, 332, 333, 123/339, 325, 493, 585, 324

[56] References Cited

U.S. PATENT DOCUMENTS 3,690,305 9/1972 Shimada et al. ..... 123/333 X
4,291,656 9/1981 Miyagi ..... 123/324 X
4,322,947 4/1982 Wössner et al. ..... 123/198 DB X
4,572,125 2/1986 Kratt ..... 123/339 X
4,572,126 2/1986 Arnold et al. ..... 123/333 X
4,619,230 10/1986 Collonia ..... 123/198 DB X

*Primary Examiner*—Willis R. Wolfe, Jr.
*Attorney, Agent, or Firm*—Walter Ottesen

[57] ABSTRACT

A method for controlling the operating characteristics of an internal combustion engine is disclosed. An injection signal for metering fuel and an idling charge signal for the supply of idling air are present. Engine overrun is also recognized in this method. To diminish the bucking ordinarily occurring during the transition to overrun, after the overrunning is recognized the supply of idling air is first reduced, and then the fuel metering to the engine is interrrupted. This affords the advantage that the transition to the overrun mode of operation occurs precisely at the time when the engine has the least possible torque. An analogous procedure is described for the resumption of normal operation following overrun.

8 Claims, 2 Drawing Figures

METHOD OF CONTROLLING THE OPERATING CHARACTERISTIC QUANTITIES OF AN INTERNAL COMBUSTION ENGINE

FIELD OF THE INVENTION

The invention relates to a method for controlling and/or regulating operating characteristic quantities of an internal combustion engine with an injection signal for metering fuel to the engine that is formed in dependence upon engine operating characteristics and with an idling charge signal for supplying air to the engine during idling that is likewise formed in dependence upon engine operating characteristics. The method also includes recognition of the overrun mode of operation of the engine.

BACKGROUND OF THE INVENTION

Interrupting the metering of fuel to the engine during overrunning for the sake of fuel economy is known. This is done for instance by recognizing engine overrunning, so that subsequently an injection signal for the metering of fuel to the engine can be influenced such that fuel metering is suppressed. At the end of overrunning, this procedure is suspended, so that normal engine operation is possible again thereafter.

However, it has been found that mixture preparation systems of this type cause bucking at the transition from normal operation to the overrun mode in which fuel metering to the engine is interrupted, and this has a perceptible negative effect on the driving behavior of the motor vehicle being driven with such an engine.

SUMMARY OF THE INVENTION

It is an object of the invention to provide a method whereby the bucking at the transition from normal engine operation to the overrunning operation is avoided. This is done by influencing the idling charge signal, after the onset of overrunning, such that the supply of idling air is reduced, and once the idling charge signal has attained a predeterminable value, the injection signal is changed in such a way that fuel metering is interrupted.

In an advantageous embodiment of the invention, when the fuel metering is interrupted the idling charge signal is set such that the idling air supply assumes a predeterminable mean value. As a result, a possible transition to engine idling operation can be reacted to quickly.

A further advantageous embodiment of the invention provides that after the end of overrunning, the injection signal is changed such that the interruption of the fuel metering is withdrawn, and the idling charge signal is influenced such that the idling air supply rises from a predeterminable low value to a predeterminable mean value. This provision assures that the transition from the overrun mode of operation to normal engine operation will also proceed without bucking that would impair the ride.

BRIEF DESCRIPTION OF THE DRAWING

The invention will now be described with reference to the drawing wherein.

DESCRIPTION OF THE PREFERRED EMBODIMENTS

Figure 1:
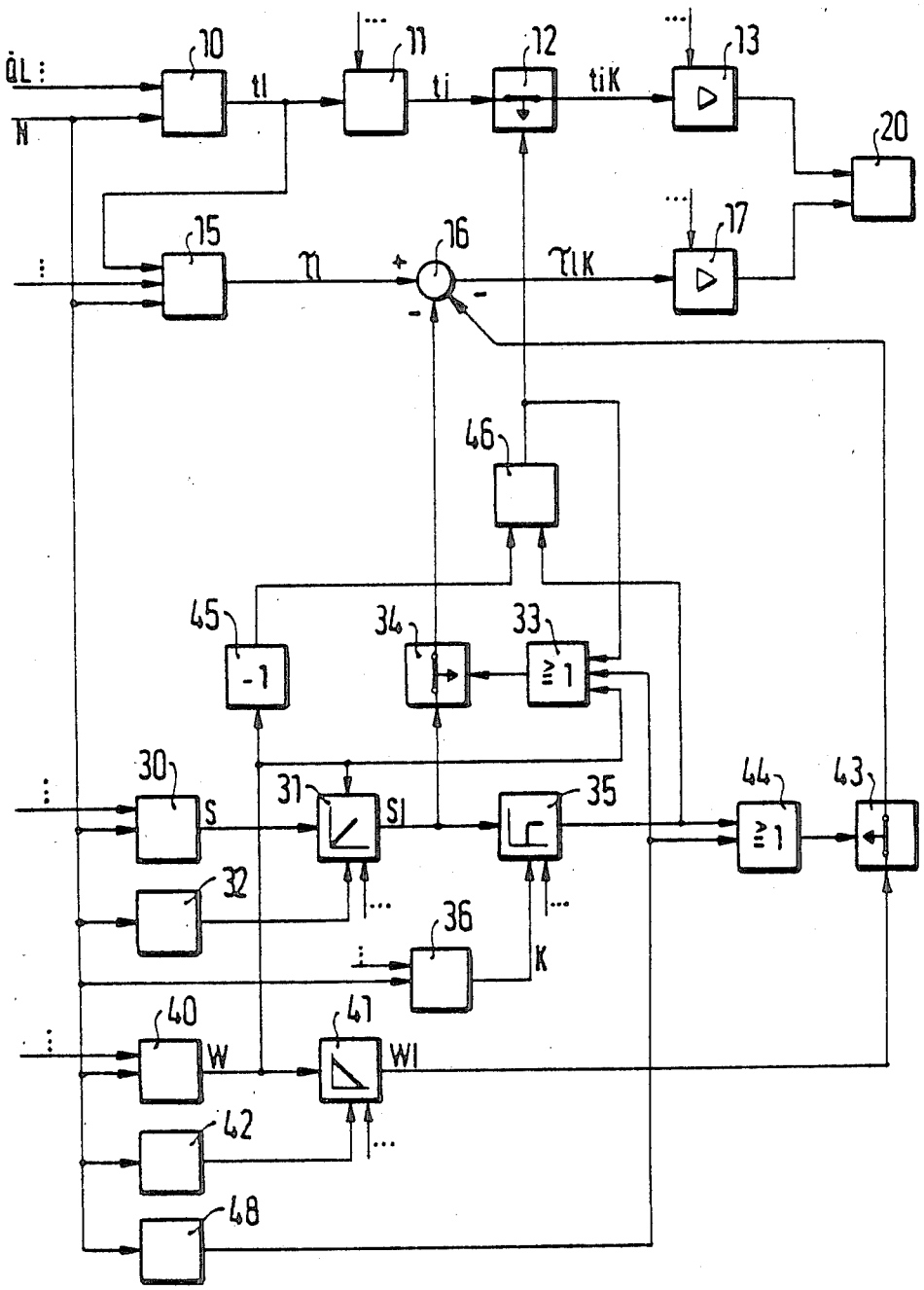
FIG. 1 is a block circuit diagram for performing the method according to the invention; and, FIG. 2 provides signal diagrams relating to the block circuit diagram of FIG. 1.

In FIG. 1, a signal relating to the quantity of air per unit of time $\dot{Q}L$ and a signal N relating to engine speed in rpm are supplied to a load signal forming means 10. A correction device 11 connected to the load signal forming means 10 forms an output signal in dependence upon its input signal, namely, the load signal t1; this output signal is the injection signal ti, which is sent to a switch device 12. The output signal of this switch device 12 is symbolized as tik and is delivered to an end stage 13, which then acts upon an internal combustion engine 20.

An idling regulating means 15 is acted upon by the engine-rpm signal N and the load signal t1, and in dependence upon these signals generates an idling charge signal $\tau$1, which is delivered to a logic element 16. This logic element 16 is also supplied with two further signals in negative form, which then together form an output signal $\tau$1k, which in turn, via an end stage 17, acts upon the engine 20.

The arrangement described thus far is known per se and can be modified in many ways by one skilled in the art. However, the specific embodiment of a mixture preparation system of this type is not essential to the invention. Of the elements mentioned above, only the switch device 12 and the logic element 16, by way of which the invention to be described below intervenes in the known system, are important for the invention.

An overrun-shutoff recognition means 30 is acted upon at least by the rotational speed signal N, in dependence upon which it forms an output signal S that triggers an overrun-shutoff integrator 31. This integrator 31 is influenced by an overrun-shutoff time constant adjuster 32, which is dependent on the rotational speed N of the engine, and by a signal W that will be explained in detail below.

The output signal SI of the integrator 31 acts upon a switch device 34, which is triggered by an OR logic element 33, and acts upon a threshold-value stage 35. The threshold value of the threshold-value stage 35 is predetermined by the output signal K of a threshold-value adjuster 36 that is dependent on the engine-rpm N.

A resume-recognition means 40 is triggered at least by a signal relating to engine-rpm N and in dependence thereon generates an output signal W that is supplied to a resume integrator 41. This integrator 41 is influenced by a resume-time constant adjuster 42 that is dependent on the engine rpm N. The output signal WI of the integrator 41 acts upon a switch device 43, which is controlled by an OR logic element 44. At one of its inputs, the OR logic element 44 is connected to the output of the threshold-value stage 35, and this signal is also connected to an AND logic element 46. The second input of the AND element 46 is acted upon, via an inverter 45, by the output signal W of block 40. This signal is also supplied to both the integrator 31 and the OR element 33. The output signal of the AND element 46 controls the switch device 12, on the one hand, and is also connected to the above-mentioned OR element 33.

Finally, an engine-rpm gradient recognition means 48, in dependence upon the engine-rpm signal N, generates an output signal that is supplied to one input each of the two OR elements 33 and 44. The output signals of the two switch devices 34 and 43, provided with a negative sign (−), finally act upon the logic element 16.

Figure 2:
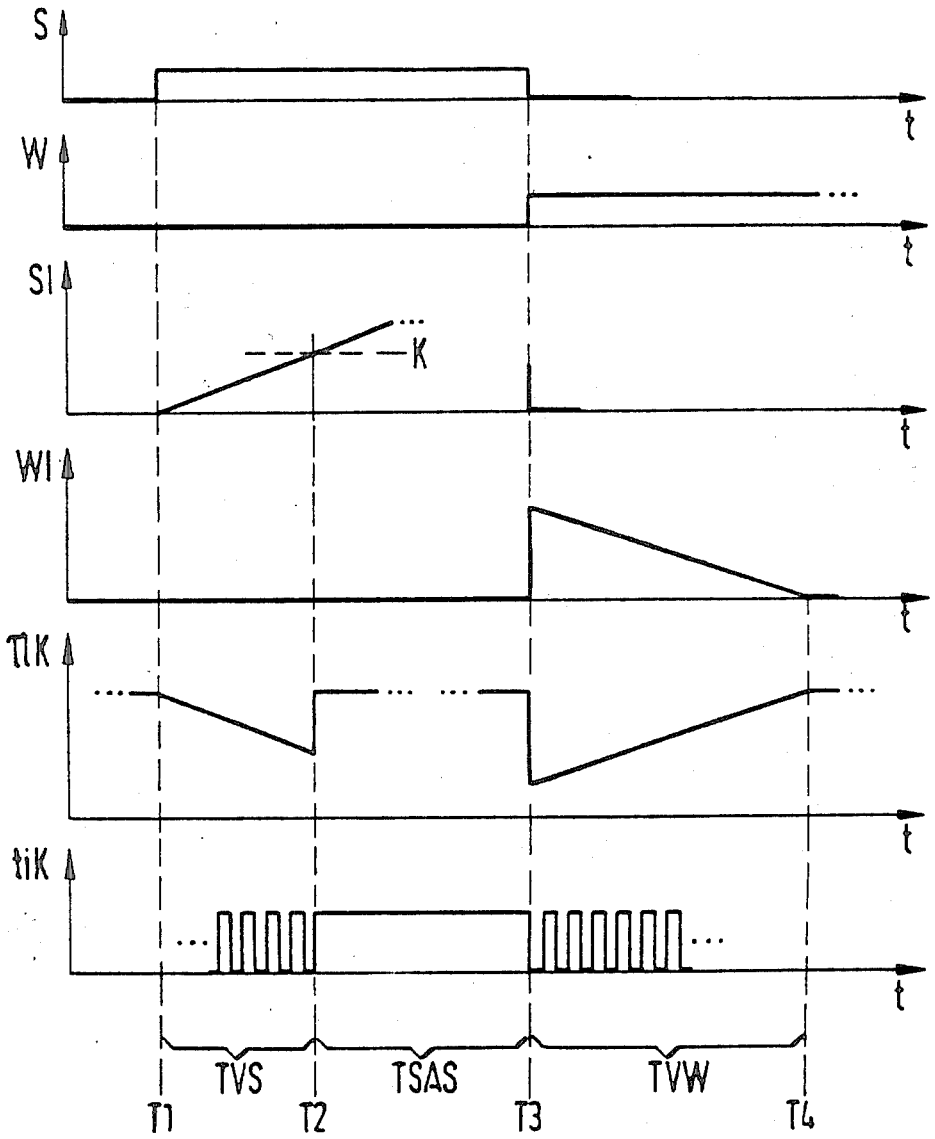

The operation of the block circuit diagram shown in FIG. 1 will now be described, referring to the signal diagrams of FIG. 2. FIG. 2 shows the course of the signals S, W, SI, WI, $\tau$1k, and tik. The symbols T1, T2, T3 and T4 in FIG. 2 represent specific points in time, while the abbreviations TVS, TSAS and TVW represent specific time durations. In all the diagrams in FIG. 2, the time t is plotted on the horizontal axis.

Prior to time T1, no overrun fuel metering shutoff has yet occurred. As a result, the two signals S and W and hence the two signals SI and WI are all zero. Because in the normal instance the output signal of the engine-rpm gradient recognition means 48 is always zero, and because furthermore the threshold K of the threshold-value stage 35 is greater than zero, all the switches 12, 34 and 43 are closed. Via the last two switches 34 and 43, however, no signal is sent on to the logic element 16. The overall result is that prior to time T1, the engine is affected solely by the injection signal ti and the idling charge signal $\tau$1, because no changes in these signals have been brought about via the switch device 12 and the logic element 16.

At time point T1, engine overrun is recognized by the overrun-shutoff recognition means 30, so the signal S jumps from 0 to 1, and the signal SI slowly begins to rise from the value zero. Via the closed switch 34, the signal SI is conducted to the logic element 16 and, in this way, the idling charge signal $\tau$1 changes so as to move toward the signal $\tau$1k. When the signal SI attains the value K of the threshold-value stage 35, the effect at the output of the stage 35 is a "1" signal, which in turn opens all the switches 12, 34 and 43. This takes place at time T2, at which the actual beginning of the overrun fuel metering shutoff occurs. Thus, after time T2, the injection signal ti is interrupted and the signal tik is "1"; this means that no fuel is injected, and the signal $\tau$1k once again assumes the value of the idling charge signal $\tau$1, because the switch 34 in particular is open. The duration TVS between the points in time T1 and T2 involves an overrun fuel metering shutoff delay, while time point T2 is then followed by the actual overrun fuel metering shutoff duration TSAS. This last-mentioned time duration ends at time point T3.

At time point T3, the signal S returns to zero, that is, overrunning is no longer present while the signal W becomes "1", which signifies a resumption after the overrun fuel metering shutoff. Because of the now existing signal W which is not equal to zero, the signal WI is set to a predeterminable output value, from which it drops slowly to zero, and at the same time the overrun-shutoff integrator 31 is reset to zero. As a result, the signal SI again drops below the value K of the threshold-value stage 35, and this causes both switch devices 12 and 43 to return to their initial state which is the closed switching condition. Only the switch device 34 remains open, because it is triggered via the OR element 33 with the "1" signal of the signal W. Thus the injection signal ti is sent on via the switch device 12, so that the signal tik corresponds to the signal ti.

The signal WI is also delivered via the switch device 43 to the logic element 16, so that the idling charge signal $\tau$1 is changed by the signal WI toward the signal $\tau$1k. The time duration TVW following time instant T3 is a regulating duration for the idling charge signal during the resumption which ends at time point T4. At this time point T4, the signal WI has again become zero, so that the idling signal $\tau$1 again corresponds to the signal $\tau$1k. Thus, after time point T4, the entire overrun fuel metering shutoff and the ensuing resumption are completed.

The overrun-shutoff time constant adjuster 32 and the resume-time constant adjuster 42 have the function of determining the rise time constants and, as required, the initial values of the signals SI and WI of the follow-on integrators 31 and 41. It is also possible for still other parameters to act upon these two integrators 31 and 41, and the situation is analogous for the threshold-value adjuster 36. The adjuster 36 has the function of adjusting the threshold value K of the threshold-value stage 35. In the present embodiment, the value of the signal K is dependent on the engine rpm N. In this connection, it is also possible for still other parameters to act upon the threshold-value stage 35 and the threshold-value stage adjuster 36.

The overrun-shutoff recognition means 30 and the resume-recognition means 40 have the function of recognizing and providing an indication of the overrun mode of operation of the engine. This recognition may be performed using the engine rpm N and, as required, other operating characteristic quantities of the engine. For instance, it is possible that overrunning occurs precisely whenever the throttle flap of the engine is located in its idling position while at the same time the engine rpm is at a level that is above the idling engine rpm by at least some predetermined value.

The signals ti or tik and $\tau$1 or $\tau$1k may be analog or digital signals. This is indicated in FIG. 2 by representing the signal tik in the form of individual injection pulses, while the signal $\tau$1k is an analog signal. In the final analysis, however, this is unimportant for the invention per se, because the end stages 13 and 17 can be used as desired to convert the injection and idling signals into appropriate drive signals of the electromagnetic final control elements.

The engine-rpm gradient recognition means 48 has the function of recognizing certain predeterminable rpm variations in order to open the switch devices 34 and 43 via the OR elements 33 and 44; that is, to reset the signal $\tau$1k abruptly to the value of the signal $\tau$1. Such specific engine-rpm drops may for instance involve a negative rpm gradient, which occurs only if the engine and the follow-on vehicle transmission are disengaged from one another. In this case, the opening of the switch devices 34 and 43 and the associated resetting to the idling charge signal $\tau$1 enable the idling regulating means 15 to optimally regulate the idling engine rpm.

Thus, in a general sense nothing in the actual mixture preparation system is changed in the embodiment of the invention described; instead, an intervention, and in particular an additive intervention, into the idling regulation of the mixture preparation is made in order to provide a more comfortable ride. As a result, the idling regulation is kept stationary, and only at the instant of the overrun shutoff and the resumption is the idling signal intentionally adjusted down to lesser values. Accordingly, the metering of fuel is interrupted at the instant when the torque is least, which minimizes bucking. It is particularly advantageous to reinforce this process still further by retarding the instant of ignition.

Thus, if the engine operating state of overrun occurs, the engine is first brought to a state of the least possible torque by reducing the supply of idling air in order to then interrupt the metering of fuel. Since the actual idling charge signal itself is not changed, however, at every moment during the overrun it is assured that the engine will not die during a possible transition to idling operation. The situation during the resumption is similar, for which the supply of idling air is increased gradually from a low value to the normal value, again without affecting the idling regulation itself. As a result, in this transition also, optimal idling regulation is possible if needed, while at the same time the bucking that normally occurs in this transition is avoided.

The comfort of the ride can be still further improved by providing that during rapid negative load changes of the engine, with a follow-on transition to the idling state, the overrun-shutoff integrator 31 is first set to a predeterminable negative value, from which the rise of the signal SI now begins, the latter signal previously having begun at zero. This provision enables further reduction of the bucking caused by the closure of the throttle flap, because in the first instant after the closure of the throttle flap more air is supplied to the engine than while the throttle flap is closed.

It is understood that the foregoing description is that of the preferred embodiments of the invention and that various changes and modifications may be made thereto without departing from the spirit and scope of the invention as defined in the appended claims.

What is claimed is:

1. Method for controlling the operating characteristic quantities of an internal combustion engine, comprising the steps of:

forming an injection signal for metering fuel to the engine in dependence upon said operating characteristic quantities;

generating an idle-speed charging signal for admitting an idle air flow to the engine which is likewise dependent upon said operating characteristic quantities;

detecting the overrun mode of operation of the engine;

influencing said charging signal after the commencement of said overrun mode so as to cause a reduction in the idle air flow;

after a predeterminable value of said charging signal is reached, changing said injection signal so as to cause the metering of fuel to the engine to be interrupted;

changing said injection signal after the end of said overrun mode so as to terminate the interruption of the metering of fuel to the engine; and, influencing said charging signal so as to cause the idle charging air to climb from a predeterminable minimal value to a predeterminable mean value.

2. Method for controlling the operating characteristic quantities of an internal combustion engine, comprising the steps of:

forming an injection signal for metering fuel to the engine in dependence upon said operating characteristic quantities;

generating an idle-speed charging signal for admitting an idle air flow to the engine which is likewise dependent upon said operating characteristic quantities;

detecting the overrun mode of operation of the engine;

influencing said charging signal after the commencement of said overrun mode so as to cause a reduction in the idle air flow;

after a predeterminable value of said charging signal is reached, changing said injection signal so as to cause the metering of fuel to the engine to be interrupted; and, influencing said charging signal when a drop in engine rpm occurs so as to cause idle charging air to take on a predeterminable mean value, said drop in engine rpm exceeding a predeterminable value.

3. Method for controlling the operating characteristic quantities of an internal combustion engine, comprising the steps of:

forming an injection signal for metering fuel to the engine in dependence upon said operating characteristic quantities;

generating an idle-speed charging signal for admitting an idle air flow to the engine which is likewise dependent upon said operating characteristic quantities;

detecting the overrun mode of operation of the engine;

influencing said charging signal after the commencement of said overrun mode so as to cause a reduction in the idle air flow; and, after a predeterminable value of said charging signal is reached, changing said injection signal so as to cause the metering of fuel to the engine to be interrupted.

4. The method of claim 3, comprising the step of adjusting said charging signal so as to cause the idle air flow to take on a predeterminable mean value when the metering of fuel to the engine is interrupted.

5. The method of claim 3, wherein the overrun mode is recognized at least in dependence upon the engine rpm.

6. The method of claim 3, wherein the influencing of said charging signal is dependent at least upon the engine rpm.

7. The method of claim 3, wherein the predeterminable value of said charging signal, which causes the interruption of the metering of fuel to the engine, is dependent upon the engine rpm.

8. The method of claim 3, wherein, after the commencement of the overrun mode, said charging signal is influenced in such a manner that the flow of idle charging air is first increased and only thereafter reduced.

* * * * *